US005936656A

United States Patent [19]

Yamaguchi

[11] Patent Number: 5,936,656

[45] Date of Patent: Aug. 10, 1999

[54] INK SHEET AND PRINTER WHICH ADJUSTS BEAM POSITION RESPONSIVE TO POLARIZATION OF REFLECTED LIGHT FROM INK SHEET

[75] Inventor: Shoji Yamaguchi, Ebina, Japan

[73] Assignee: Fuji Xerox Co., Ltd., Tokyo, Japan

[21] Appl. No.: 08/554,590

[22] Filed: Nov. 6, 1995

[30] Foreign Application Priority Data

Nov. 7, 1994 [JP] Japan ..... HEI 6-272559

[51] Int. Cl.[6] ..... B41J 2/435

[52] U.S. Cl. ..... 347/234; 347/248; 347/262

[58] Field of Search ..... 347/234, 248, 347/221, 243, 259, 260, 261, 233, 262; 250/559.05, 559.09

[56] References Cited

U.S. PATENT DOCUMENTS

| | | | |
|---|---|---|---|
| 4,253,775 | 3/1981 | Crooks et al. | 400/198 |
| 4,412,264 | 10/1983 | Imamura et al. | 360/131 |
| 4,693,548 | 9/1987 | Tsunoi | 347/243 |
| 4,720,480 | 1/1988 | Ito et al. | 503/227 |
| 5,140,342 | 8/1992 | Metildi et al. | 347/232 |
| 5,567,066 | 10/1996 | Paranjpe | 400/249 |

FOREIGN PATENT DOCUMENTS

| | | | |
|---|---|---|---|
| 3-026595 | 2/1991 | Japan | B41J 5/38 |
| 6-418 | 1/1994 | Japan . | |

OTHER PUBLICATIONS

Odai et al., "Halftone Color Imaging by Laser Dye Transfer", Mitsubishi Nonimpact Printing Technology 1993, pp. 362–365.

*Primary Examiner*—David F. Yockey
*Attorney, Agent, or Firm*—Oliff & Berridge, PLC

[57] ABSTRACT

An ink sheet having an ink layer, containing ink to be molten by heat generated by its absorption of received light, includes a magnetic layer being magnetized to have a preset magnetic pattern. The direction of polarization of the reflecting light varies depending on a state of the magnetization on the magnetic layer when part of the received light is incident on and reflected from the magnetic layer. The ink sheet is combined with a printer in which a recording medium and the ink sheet are coupled together, and ink is transferred to the recording medium when the ink sheet receives light. The printer includes optical heads for projecting a light beam upon the ink sheet while moving in the width direction of the ink sheet, sensors for sensing a state of polarization of the light beam reflected from the ink sheet, and actuators for adjusting an irradiating position of the light beam on the ink sheet on the basis of a state of polarization of the reflecting light that is sensed by the sensor.

12 Claims, 12 Drawing Sheets

IT IS SHOWN THAT THE DIRECTIONS OF MAGNETIZATION ARE DIFFERENT FROM EACH OTHER
1
REGION n
REGION 2
REGION 1
13nc
13nb
132c
132b
131c
X
Y
(m+1)TH LINE
m - TH LINE

INK SHEET AND PRINTER WHICH ADJUSTS BEAM POSITION RESPONSIVE TO POLARIZATION OF REFLECTED LIGHT FROM INK SHEET

BACKGROUND OF THE INVENTION

The present invention relates to a printer of the called laser thermal-transfer type in which ink of an ink sheet is molten by heat energy of focused laser beam, and transferred onto a print sheet for image formation, and an ink sheet used for the printer.

The printer of the called laser thermal-transfer type has been known ("Halftone Color Imaging Laser Dye Transfer", Mitsubishi Nonimpact Printing Technology '93, and Japanese Patent Publication No. Hei. 6-418).

FIG. 14 shows in schematic and block form a conventional printer of the laser thermal-transfer type.

As shown in FIG. 14, an ink sheet 1 is placed on a print sheet 2 on a drum 3. A DC motor 5 is directly coupled with the drum 3. A controller 6 receives a command from a personal computer 4, and issues a command to the drum 3. Upon receipt of the command, the drum 3 is driven to turn with a high precision. With turn of the drum 3, the ink sheet 1 and the print sheet 2 are transported in the transport direction indicated by an arrow Y (referred to the transport direction Y). An optical head 8 is located facing the drum 3. The optical head 8 is supported by a movement stage 9. The movement stage 9 includes a stepping motor (not shown), which moves the optical head 8 in the width directions (indicated by the double arrow X) of the ink sheet 1 (The directions will be (referred to simply as the width direction X.). The stepping motor is driven by a stepping motor drive circuit 10, which receives a command from the controller 6. A semiconductor laser is assembled into the optical head 8. The semiconductor laser is driven by an LD driver 7, which receives a command from the controller 6.

FIG. 15 is a diagram schematically showing the inner structure of an optical head shown in block form in FIG. 14. As shown in FIG. 15, laser beams are emitted from a semiconductor laser 8-1, collimated by a collimator lens 8-2, shaped into a circular beam by a shaping prism 8-3 (since the laser beam emitted from the semiconductor laser 8-1 is elliptical in cross section), focused into a light spot of approximately 10 $\mu$m, for example, and projected onto the ink sheet 1.

FIG. 16 is a sectional view showing the structure of the ink sheet. In the structure of the ink sheet 1, a light absorbing layer 1-2 and an ink layer 1-3 are layered on a transparent base film 1-1. A laser beam enters the ink sheet 1 through the light absorbing layer 1-2, and reaches a point on the light absorbing layer 1-2. In the light absorbing layer 1-2, the laser beam is transformed into thermal energy. With the thermal energy, the ink layer is molten. The molten ink is transferred from the ink layer 1-3 to the print sheet 2 that is layered on the ink layer 1-3 of the ink sheet 1. In this way, an image (including characters) is printed on the print sheet 2.

In the printer of the laser thermal-transfer type, one dot in a printed image may be reduced to a size near to the diameter of the focused light spot, e.g., approximately 10 $\mu$m. Accordingly, this type of the printer is capable of printing an image of high definition. To produce a printed picture or a formed image of high definition, it is necessary to reduce the beam spot diameter as small as possible. With reduction of the spot diameter, the laser beam must be brought to irradiate exactly at a desired position on the ink sheet 1. To this end, an irregularity or nonuniformity must be minimized in the drum speed of the drum with the ink sheet 1 located thereon. However, it is very difficult to realize such a precise control of the irradiating of the beam spot.

The printing speed of the printer of the laser thermal-transfer type is considerably slower than that of the thermal head type printer since the former transforms optical energy of the light spot into thermal energy to melt ink, while the latter uses a heat generating resistor element. An approach to increase the printing speed of the thermal-transfer type printer is to array a plural number of optical heads in the direction of an arrow X in FIG. 14 and to simultaneously drive these optical heads for printing. A precise control of relatively positioning the laser beam spots, which are emitted from the plural number of the optical heads, on the ink sheet 1 is essential to the approach. In the approach using the plural number of the optical heads, the control of the irradiating positions is very difficult when comparing with that in the thermal-transfer type printer using a single optical head.

SUMMARY OF THE INVENTION

The present invention has been made in view of the above circumstances and has an object to provide a printer of the laser thermal-transfer type which is able to precisely control the relative irradiating positions of a plural number of optical heads on the ink sheet.

Another object of the present invention is to provide an ink sheet well adequate for the above printer.

According to an aspect of the present invention, there is provided an ink sheet having an ink layer containing ink to be molten by heat generated by its absorption of received light. The ink sheet comprises a magnetic layer being magnetized to have a preset magnetic pattern, when part of the received light is incident on and reflected from the magnetic layer, the direction of polarization of the reflecting light varies depending on a state of the magnetization on the magnetic layer.

A magnetic pattern that alternately or cyclically varies in the transport direction of the ink sheet is preferable for the magnetic pattern.

A magnetic pattern covering a part of the magnetic layer that alternately or cyclically varies in the width direction of the ink sheet, is also preferable for the magnetic pattern.

As described above, the ink sheet of the present invention includes a magnetic layer being magnetized to have a preset magnetic pattern, when part of the received light is incident on and reflected from the magnetic layer, the direction of polarization of the reflecting light varying depending on a state of the magnetization on the magnetic layer. A magnetic pattern that alternately or cyclically varies in the transport or the width direction of the ink sheet may be used for the magnetic pattern formed on the magnetic sheet. When the ink sheet including such a magnetic layer is combined with the printer of the present invention, the optical heads may be extremely exactly positioned. A picture printed by the printer has a high definition.

According to another aspect of the present invention, there is provided a printer in which a recording medium and an ink sheet are coupled together, the ink sheet including an ink layer containing ink to be molten by heat generated by its absorption of received light, and a magnetic layer being magnetized to have a preset magnetic pattern, when part of the received light is incident on and reflected from the magnetic layer, the direction of polarization of the reflecting light varying depending on a state of the magnetization on the magnetic layer, and ink is transferred to the recording medium when the ink sheet receives light. The printer is comprised of: beam projecting means for projecting a light beam upon the ink sheet while moving in the width direction of the ink sheet; sensing means for sensing a state of polarization of the light beam reflected from the ink sheet; and irradiating position adjusting means for adjusting an irradiating position of the light beam on the ink sheet on the basis of a state of polarization of the reflecting light that is sensed by the sensing means, the light beam projected from the light beam projecting means irradiating on the irradiating position on the ink sheet.

In the thus constructed printer, beam projecting means projects a light beam upon the ink sheet while moving in the width direction of the ink sheet. A state of polarization of the light reflected from the magnetic layer of the ink sheet changes depending on a state of magnetization at the position on the magnetic layer on which the light beam impinges (Kerr effect). In the printer using the above-mentioned ink sheet, sensing means senses a state of polarization of the light beam reflected from the ink sheet, and the irradiating position adjusting means adjusts an irradiating position of the light beam on the ink sheet on the basis of a state of polarization of the reflecting light that is sensed by the sensing means. Incidentally, the light beam projected from the light beam projecting means irradiates on the irradiating position on the ink sheet. The printer may be arranged such that light beam projecting means includes a plural number of optical heads, irradiating position adjusting means includes a plural number of actuators, which are respectively associated with the plural number of optical heads, and each of the actuators adjusts an irradiating position of the light beam, which is projected from the optical head associated therewith, on the ink sheet.

The printer may also be arranged such that light beam projecting means includes groups of optical heads, irradiating position adjusting means includes a plural number of actuators, and each of the actuators is associated with one of the groups of optical heads, and adjusts irradiating positions of the light beams, which are projected from the optical heads associated therewith, on the ink sheet.

Further, the printer may be arranged such that the magnetic pattern alternately or cyclically varies in the transport direction of the ink sheet, and irradiating position adjusting means adjusts an irradiating position of the light beam, which is projected from the light beam projecting means, on the ink sheet when viewed in the transport direction.

In the printer thus constructed, a plural number of optical heads are respectively combined with a plural number of actuators. Use of those couples of an optical head and an actuator, the printing speed is considerably increased, and the printed picture is high in definition.

Further, when the relative positions of the plural number of optical heads are adjusted in advance, a plural number of optical heads may be driven by one actuator.

Further, the printer uses an ink sheet in which the magnetic pattern alternately or cyclically varies in the transport direction of the ink sheet (direction Y in FIG. 14), and the irradiating position adjusting means adjusts an irradiating position of the light beam, which is projected from the light beam projecting means, on the ink sheet when viewed in the transport direction. With this unique construction, the printed image is free from its deformation in the transport direction.

Additionally, the printer of the present invention may be arranged as follows: the printer in which a recording medium and an ink sheet are coupled together, the ink sheet including an ink layer containing ink to be molten by heat generated by its absorption of received light, and a magnetic layer being magnetized to have a preset magnetic pattern alternately or cyclically varies in the transport and the width direction of the ink sheet, when part of the received light is incident on and reflected from the magnetic layer, the direction of polarization of the reflecting light varying depending on a state of the magnetization on the magnetic layer, and ink is transferred to the recording medium when the ink sheet receives light, the printer comprising:

light beam projecting means for projecting a light beam upon the ink sheet while moving in the width direction of the ink sheet;

sensing means for sensing a state of polarization of the light beam reflected from the ink sheet;

irradiating position adjusting means for adjusting an irradiating position of the light beam on the ink sheet on the basis of a state of polarization of the reflecting light that is sensed by the sensing means, the light beam projected from the light beam projecting means irradiating on the irradiating position on the ink sheet, the magnetic layer having a second magnetic pattern in a second portion thereon, the second magnetic pattern alternately or cyclically varying in the width direction of the ink sheet; second light beam projecting means for projecting a light beam upon the second portion on the ink sheet while moving in the width direction of the ink sheet;

second sensing means for sensing a state of polarization of the light beam reflected from the second portion on the ink sheet; and detecting means for detecting a position of the second light beam projecting means relative to the ink sheet when viewed in the width direction of the ink sheet, on the basis of a state of polarization of the reflecting light that is sensed by the second sensing means.

With this arrangement, when the ink sheet or the print sheet is moved simply or irregularly in the width direction, the detecting means detects such a simple or irregular motion of the sheet, and the optical heads are moved following up such a motion of the sheet or the timing of projecting the light beam is controlled on the result of the detection. The irradiating positions of the light beams are adjusted also in the width direction. The definition of the printed picture is further improved.

BRIEF DESCRIPTION OF THE DRAWINGS

The accompanying drawings, which are incorporated in and constitute a part of this specification, illustrate embodiments of the invention and, together with the description, serve to explain the objects, advantages and principles of the invention. In the drawings.

DETAILED DESCRIPTION OF THE PREFERRED EMBODIMENTS

The preferred embodiments of the present invention will be described with reference to the accompanying drawings.

Figure 1:
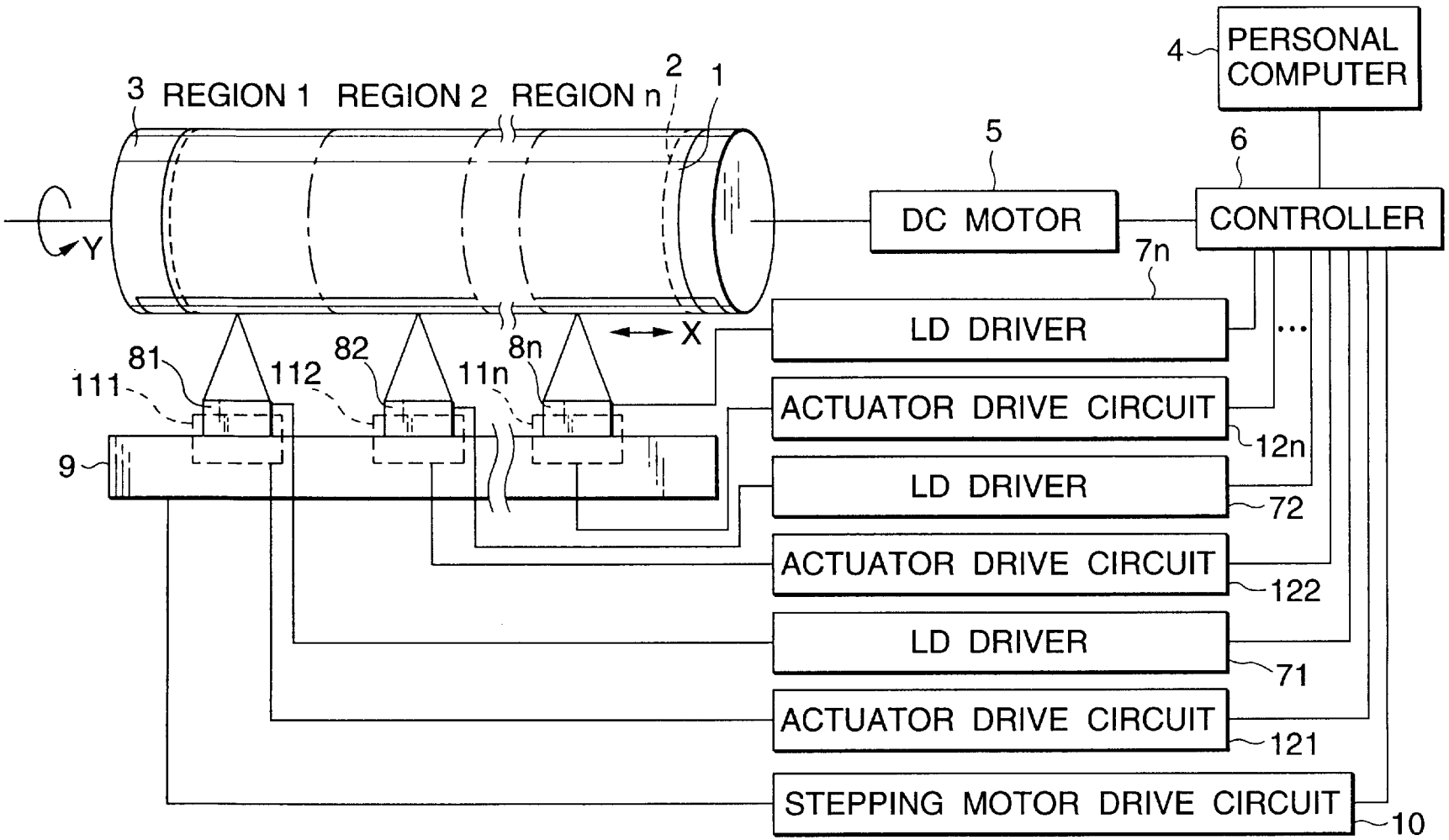
FIG. 1 is a diagram showing in schematic and block form an embodiment of a printer of the laser thermal-transfer type according to the present invention.
Figure 14:
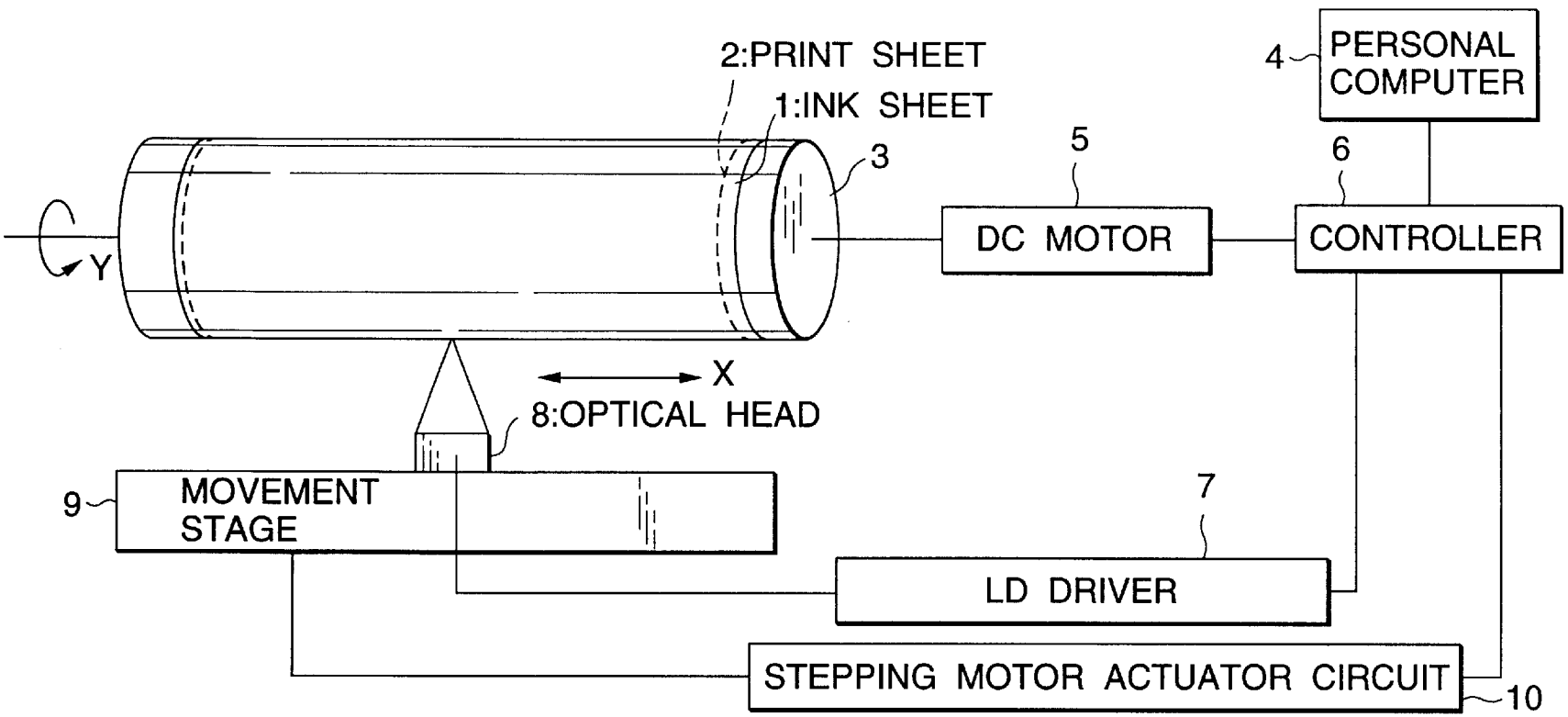
FIG.14 PRIOR ART
FIG. 14 shows in schematic and block form a conventional printer of the laser thermal-transfer type.

FIG. 1 is a diagram showing in schematic and block form an embodiment of a printer of the laser thermal-transfer type according to the present invention. In the figure, like. reference numerals are used for designating like or equivalent portions in FIG. 14 showing the conventional printer of this type.

Figure 15:
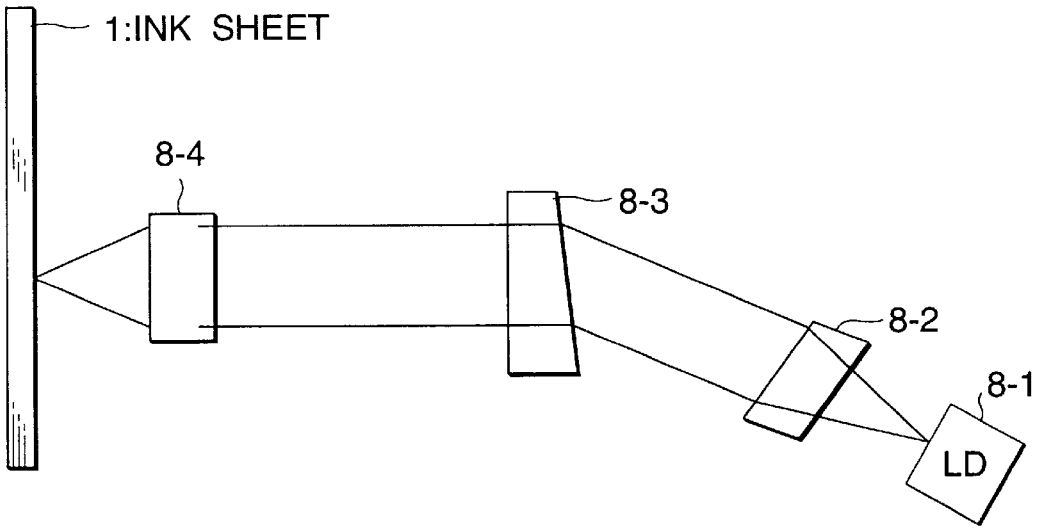
FIG.15 PRIOR ART
FIG. 15 is a diagram schematically showing the inner structure of an optical head shown in block form in FIG. 14.

In the printer shown in FIG. 1, a plural number of optical heads 81, 82, . . . , 8*n* are provided on a movement stage 9, while being arrayed in the directions are indicated by the double arrow X. The relative positions of the optical heads 81, 82, . . . , 8*n*, which are arrayed along the longitudinal side of the drum 3, are adjusted in advance in an initial adjusting stage. The optical heads 81, 82, . . . , 8*n* are moved in the width direction X by a stepping motor (not shown), which is driven by a stepping motor drive circuit 10, while keeping the relative positions of the optical heads 81, 82, . . . , 8*n*. Semiconductor lasers 8-1 (FIGS. 6 and 15) contained in the optical heads 81, 82, . . . , 8*n* are respectively driven by LD drivers 71, 72, . . . , 7*n* associated with the optical heads, and emit laser beams to regions 1, 2, . . . , n on the ink sheet 1. In the optical heads 81, 82, . . . , 8*n*, objectives 8-4 (FIGS. 2, 6 and 15) are fastened to actuators 111, 112, . . . , 11*n*, respectively. The actuators 111, 112, . . . , 11*n* are respectively coupled with actuator drive circuits 121, 122, 12*n* which receive a drive command from a controller 6. When driven by the actuator drive circuits, the actuators 111, 112, . . . , 11*n* minutely move the objectives 8-4 of the optical heads 81, 82, . . . , 8*n* in the transport direction Y, thereby making a fine adjustment of the irradiating positions of the laser beams on the ink sheet 1.

Figure 2:
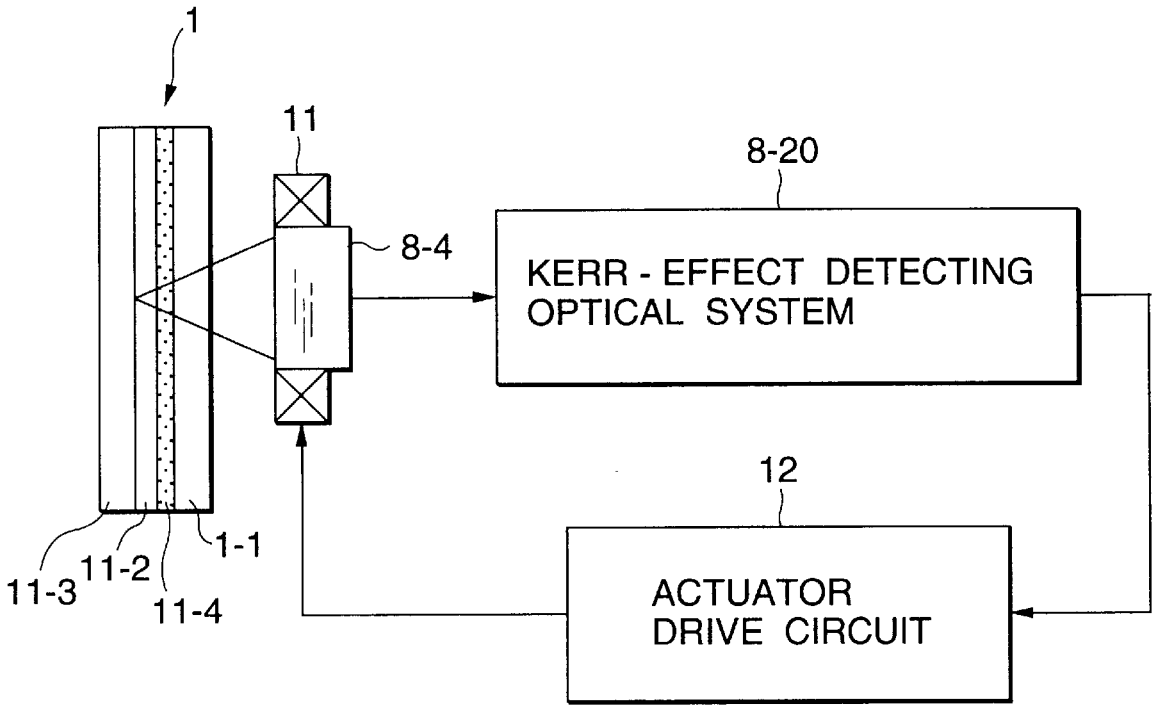
FIG. 2 is a diagram showing the cross section of an ink sheet according to an embodiment of the present invention and one of the optical heads used in the printer shown in FIG. 1.

FIG. 2 is a diagram showing the cross section of the ink sheet 1, which is an embodiment of the present invention, one of the optical heads used in the printer shown in FIG. 1, and its related circuits.

Figure 16:
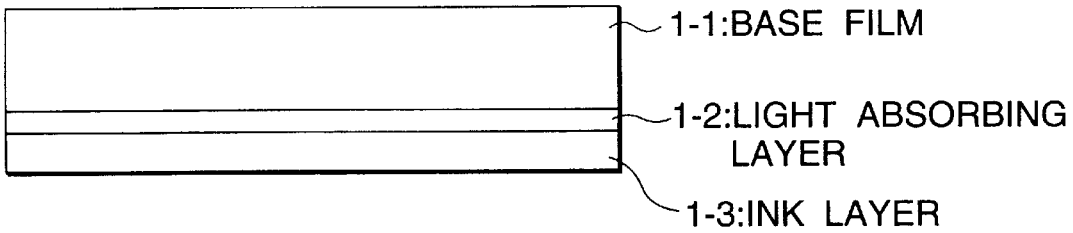
FIG.16 PRIOR ART
FIG. 16 is a sectional view showing the structure of the ink sheet.

The structure of the ink sheet 1 shown in FIG. 2 is equivalent to that of the conventional ink sheet shown in FIG. 16 in which a magnetic layer 11-4 is additionally provided between the transparent base film 1-1 and the light absorbing layer 1-2. In the FIG. 2 structure, the transparent base film, the light absorbing layer, and the ink layer are designated by reference numerals 11-1, 11-2, and 11-3, respectively. The magnetic layer 11-4 may additionally have the function of the light absorbing layer 1-2. The magnetic layer 11-4 is magnetized to have a preset magnetization pattern. The magnetization pattern will be described in detail later.

A laser beam, which emanates from the objective 8-4, is focused at a point on the ink sheet 1. The laser beam is absorbed by the light absorbing layer 11-2 and transformed into thermal energy. The ink layer 11-3 is molten at the beam spot. The molten ink is transferred onto the print sheet 2 layered on the ink sheet 1 as shown in FIG. 1, to thereby effect the print of an image. On the other hand, part (about 10%) of the laser beam emanating from the objective 8-4 is reflected on the magnetic layer 11-4, passes through the objective 8-4 again, and enters a Kerr-effect detecting optical system 8-20. The laser beam when reflected from the magnetic layer 11-4 experiences a change of a state of polarization, and the change of the polarization state depends on a state of the magnetization at the reflection point on the magnetic layer 11-4 (this phenomenon is known as Kerr effect). A state of the polarization of the reflecting light from the magnetic layer 11-4 is detected by the Kerr-effect detecting optical system 8-20. The result of the detection is inputted to the controller 6 (FIG. 1), and the controller 6 drives the actuator drive circuit 12 on the basis of the detection result. In FIG. 2, the controller 6 is not illustrated, for simplicity.

Figure 3:
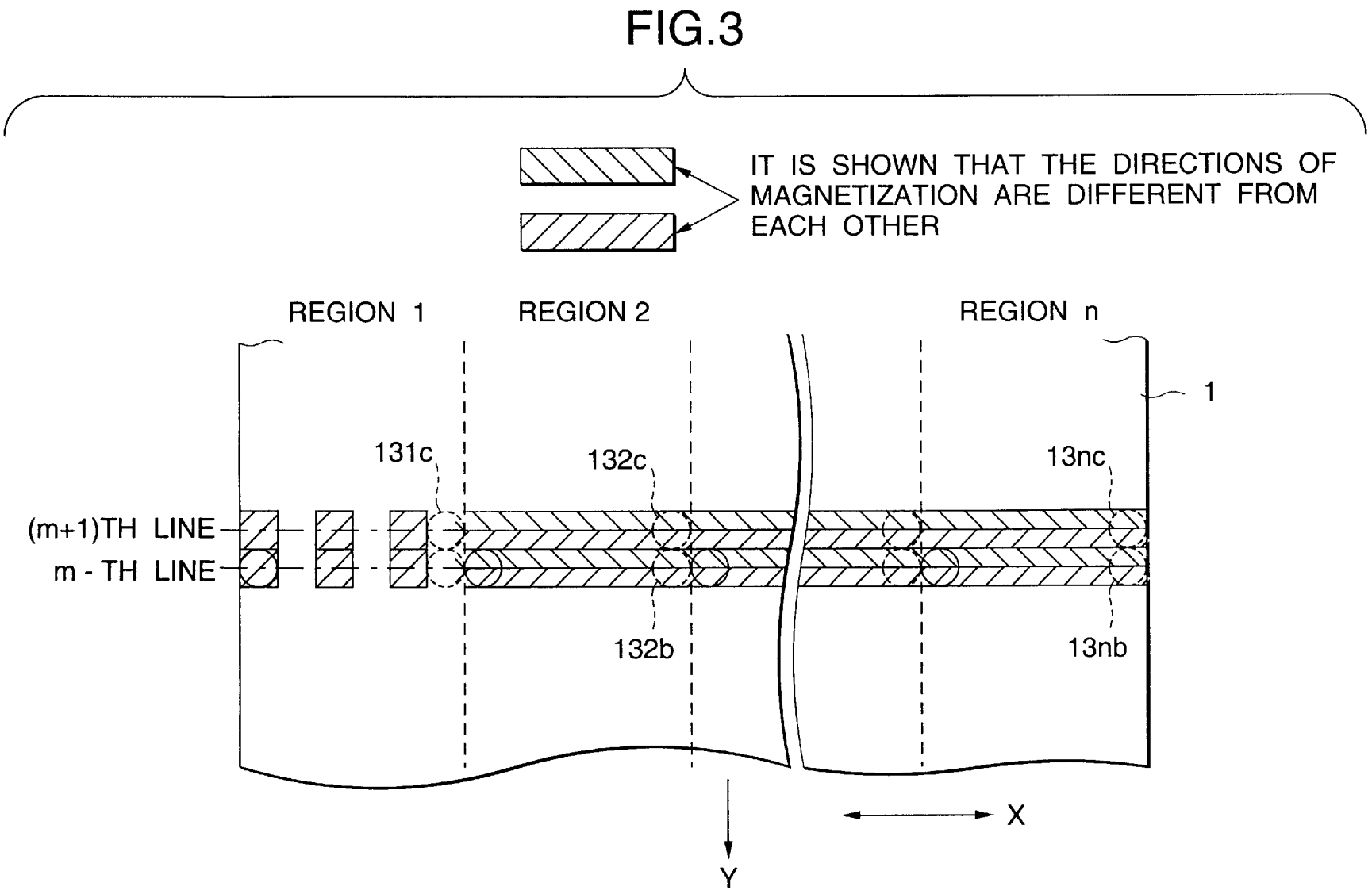
FIG. 3 is a diagram showing typical magnetization patterns on an ink sheet according to an embodiment of the present invention.
Figure 4:
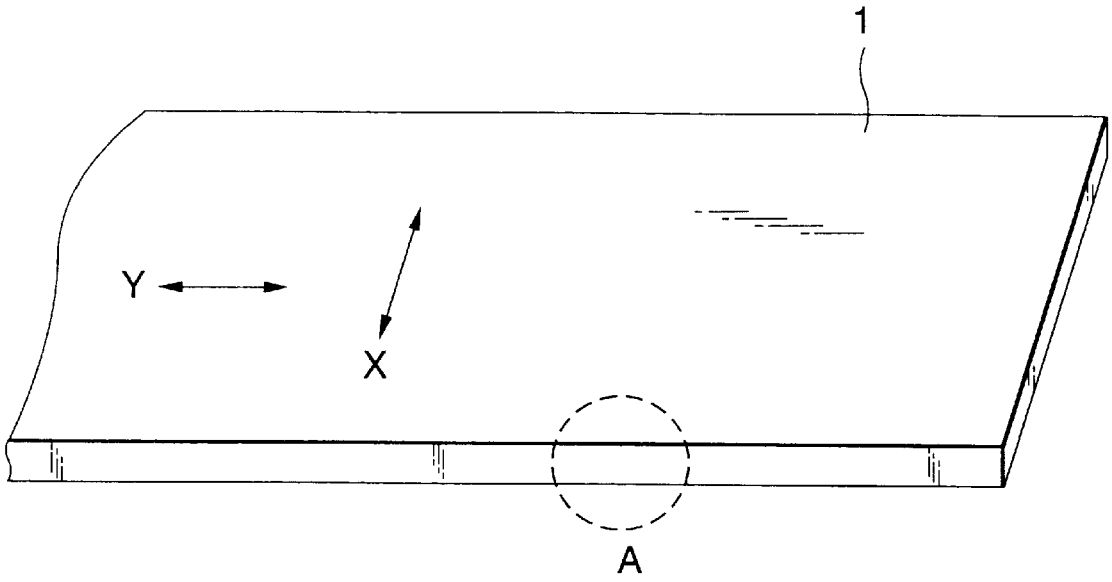
FIG. 4 is a perspective view showing the ink sheet of FIG. 3.
Figure 5:
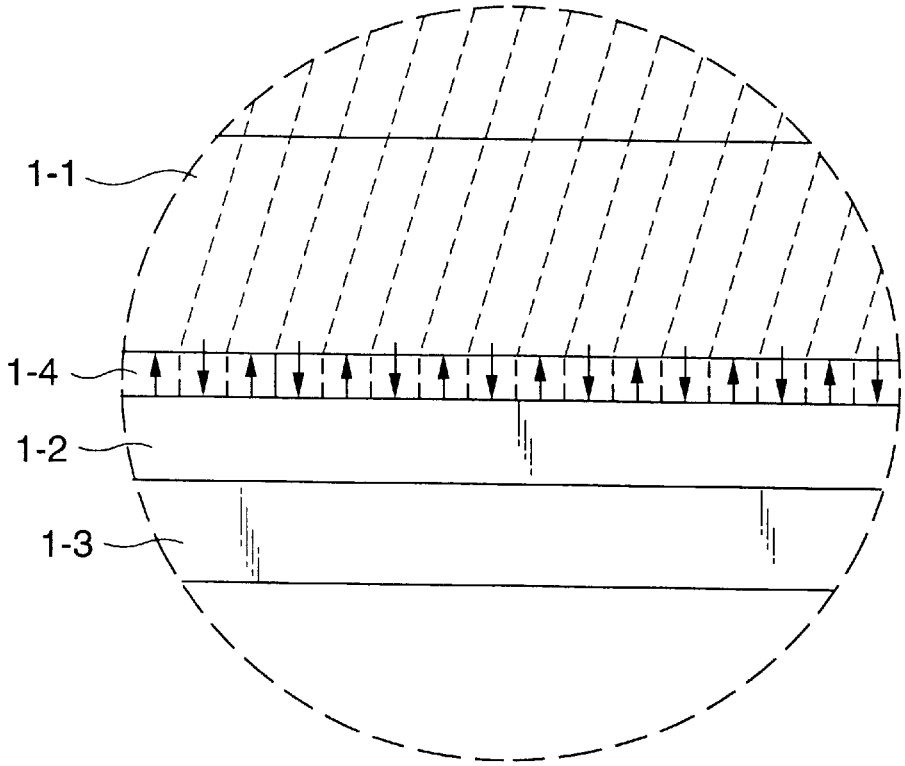
FIG. 5 is an enlarged view showing a circled portion of the ink sheet of FIG. 4.

FIG. 3 is a diagram showing a model of a magnetization pattern on an ink sheet according to an embodiment of the present invention. FIG. 4 is a perspective view showing the ink sheet of FIG. 3. FIG. 5 is an enlarged view showing a circled portion A of the ink sheet of FIG. 4.

The optical heads 81, 82, . . . , 8*n* project laser beams to the regions 1, 2, . . . , n on the ink sheet 1, respectively. At this time, light spots 131, 132, . . . , 13*n* are formed on the ink sheet 1, as shown in FIG. 3. To more specific, when the laser beams from the optical heads 81, 82, . . . , 8*n* are directed to the m-th line on the ink sheet 1, 1) the light spots 131, 132, . . . , 13*n* are initially formed at the positions indicated by solid lines in FIG. 3 on the m-th line. The light spots of those positions are denoted as 131*a*, 132*a*, . . . , 13*na*.

2) Then, the optical heads 81, 82, . . . , 8*n* are simultaneously moved to the right (FIGS. 1 and 3) by the stepping motor (not shown), driven by the stepping motor drive circuit 10 (FIG. 1). With the movement of the optical heads, the light spots 131, 132, . . . , 13*n* are also moved to the right, and set at positions indicated by broken lines. The light spots of those positions are denoted as 131*b*, 132*b*, . . . , 13*nb*.

3) Then, the DC motor 5 (FIG. 1) is turned to move the ink sheet 1 and the print sheet 2 in the transport direction Y. As a result, the light spots 131, 132, . . . , 13*n* are moved to positions (designated by numerals 131*c*, 132*c*, . . . , 13*nc*) on the (m+1)th line, respectively.

4) Thereafter, the optical heads 81, 82, . . . , 8*n* are moved to the left (FIGS. 1 and 3), and the light spots 131, 132, . . . , 13*n* are also moved to the left on the (m+1)th line (FIG. 3).

In this embodiment, the diameter of each of the light spots 131, 132, . . . , 13*n* is set at 10 μm. In the region 1 on the ink sheet 1, magnetized portions (slanted portions) and nonmagnetized portions are alternately arrayed at the intervals of the spot diameter in the width direction X. In the remaining regions 2 to n, a plural number of strips are extended in the width direction X, while being arrayed at the intervals of 5 μm in the transport direction Y. Those strips are uniformly magnetized in the transport direction Y but the directions of the magnetization of the adjacent magnetized strips when viewed in the transport direction Y are different from each other. Thus, the magnetized patterns of the first and the second directions of magnetization are alternately arrayed in the transport direction Y.

In FIG. 5, the directions of the magnetized areas on the magnetic layer 11-4 are indicated by arrows.

In FIG. 3, only two magnetic patterns on the m and the (m+1)th lines are illustrated, for simplicity. Actually, those patterns are formed over the entire surface of the ink sheet 1.

Figure 6:
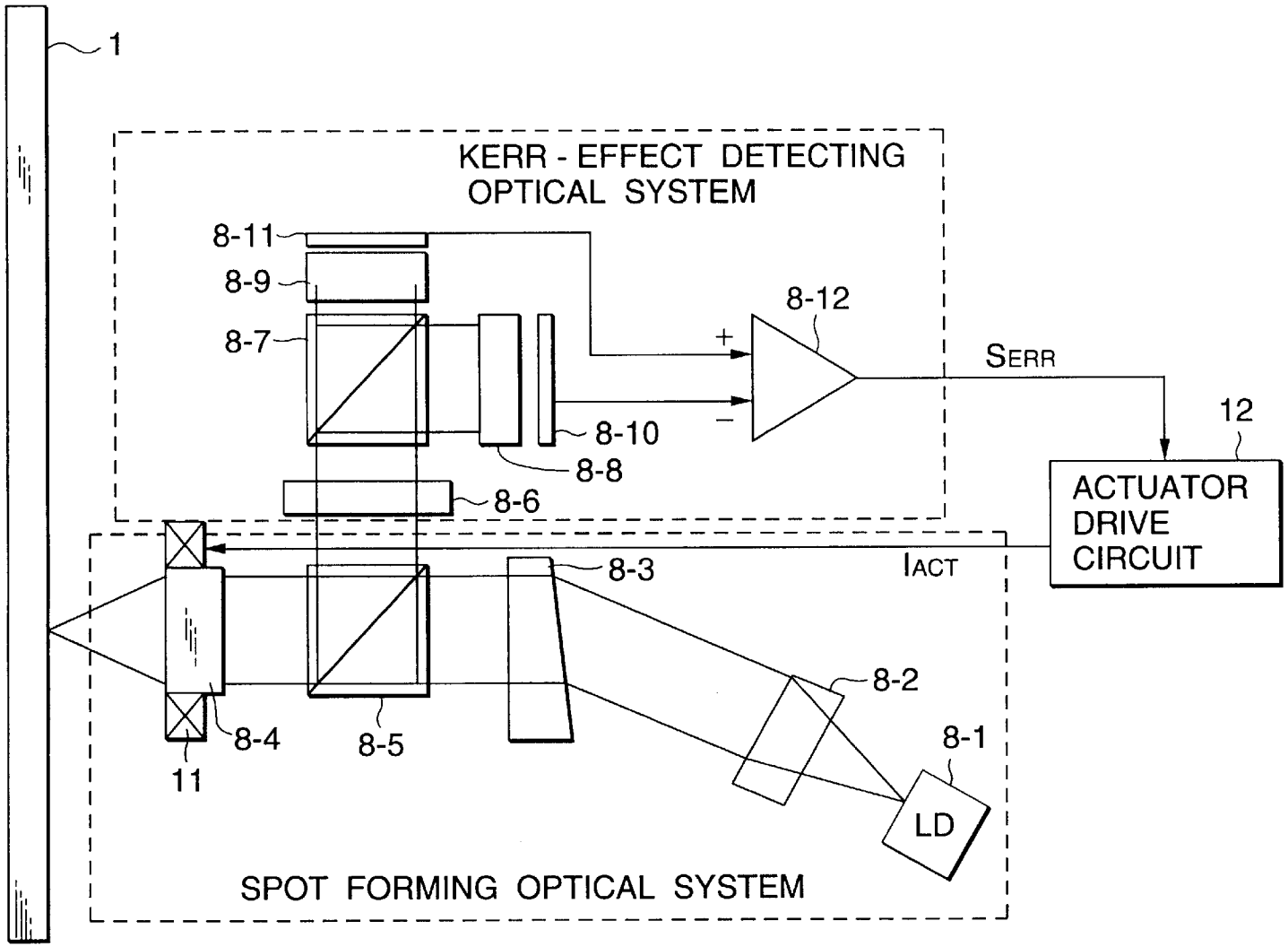
FIG. 6 is a diagram showing the internal construction of one of the optical heads in the printer shown in FIG. 1.

FIG. 6 is a diagram showing the internal construction of one of the optical heads (except the optical head allotted to the region 1) in the printer shown in FIG. 1. As shown, the optical head includes a spot forming optical system, which is similar in construction to that of the conventional optical head shown in FIG. 15, and the Kerr-effect detecting optical system shown in FIG. 2. The spot forming optical system of the optical head shown in FIG. 6 is different from the corresponding one shown in FIG. 15 in that an actuator 11 and a beam splitter 85 are additionally used.

The light reflected from the magnetic layer 11-4 (FIG. 2) of the ink sheet 1 passes through the objective 8-4, is reflected by a beam splitter 8-5, and enters the Kerr-effect detecting optical system. In the Kerr-effect detecting optical system, the plane of the polarization of the reflecting light is turned at 45° by a ½ wave plate 8-6, and enters a polarized-light beam splitter 8-7. In the polarized-light beam splitter 8-7, the reflecting light is split into two components (s-polarized light and p-polarized light) of which the planes of polarization are perpendicular to each other. The s- and p-polarized light are condensed by condenser lenses 8-8 and 8-9, and the amounts of the light are detected by sensors 8-10 and 8-11. The output signals of the sensors 8-10 and 8-11 are inputted to a differential amplifier 8-12, which in turn produces a tracking error signal SERR representative of a difference between the sensor output signals. The tracking error signal $S_{ERR}$ is inputted through the controller 6 (not illustrated in FIG. 6, but see FIG. 1) to the actuator drive circuit 12. The actuator drive circuit 12 produces an actuator drive current $I_{ACT}$, which depends on the tracking error signal $S_{ERR}$ received, and applies it to the actuator 11, to thereby adjust the position of the objective 8-4, viz., the position of a light spot on the ink sheet 1.

Figure 7:
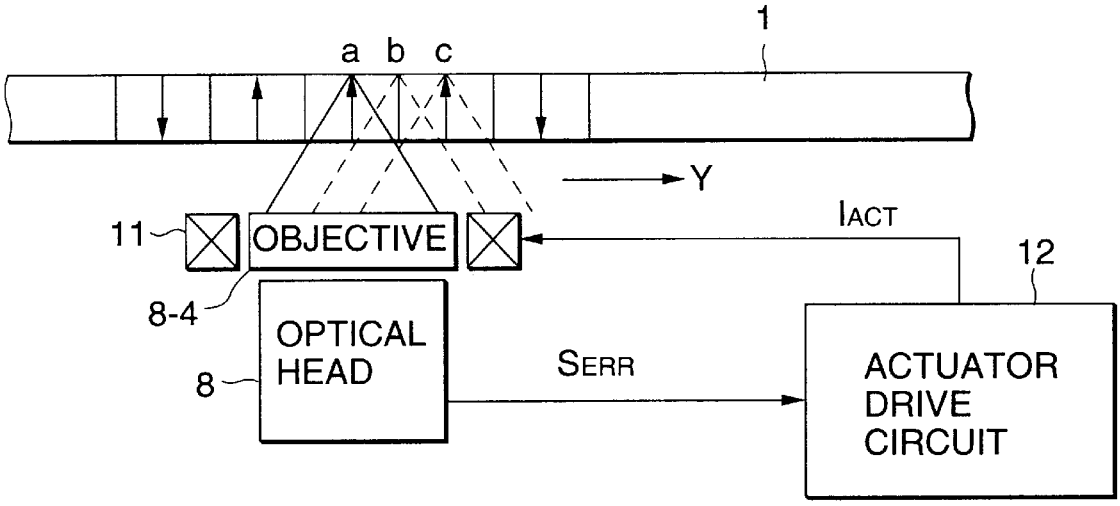
FIG. 7 is a diagram useful in explaining a feedback control system shown in FIG. 6.
Figure 8A:
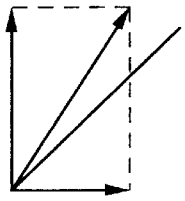
FIGS. 8A to 8C are vector diagrams showing the polarization of light reflected at different points on the ink sheet.
Figure 8B:
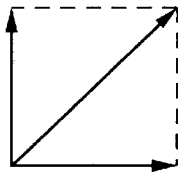
Figure 8C:
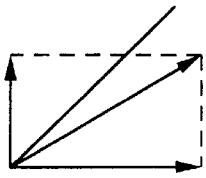
Figure 9:
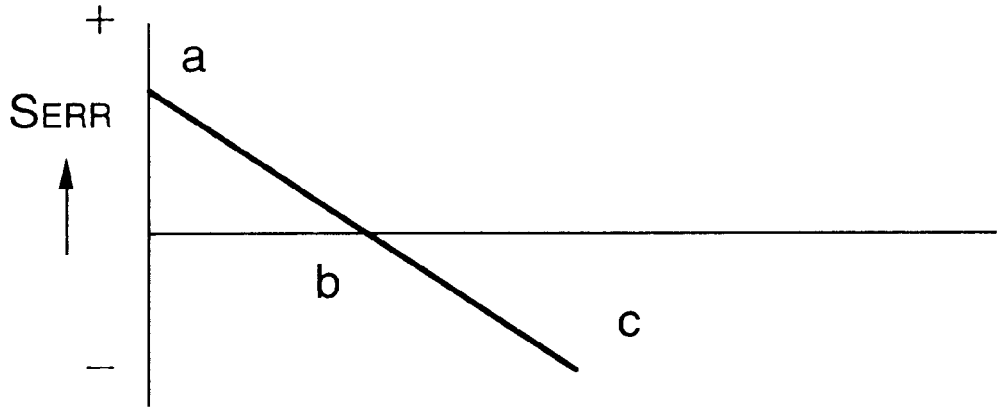
FIG. 9 is a graph showing a level variation of a tracking error signal $S_{ERR}$ outputted from a Kerr-effect detecting optical system.
Figure 10:
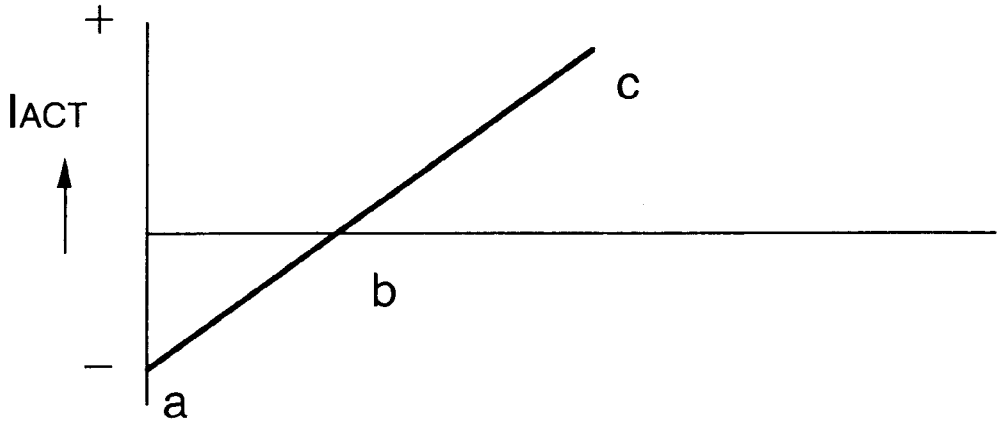
FIG. 10 is a graph showing a level variation of an actuator drive current $I_{ACT}$ outputted from an actuator drive circuit.

FIG. 7 is a diagram useful in explaining the feedback control system shown in FIG. 6. FIGS. 8A to 8C are vector diagrams showing the polarization of light reflected at different points on the ink sheet. FIG. 9 is a graph showing a level variation of a tracking error signal $S_{ERR}$ outputted from a Kerr-effect detecting optical system. FIG. 10 is a graph showing a level variation of an actuator drive current $I_{ACT}$ outputted from an actuator drive circuit.

In FIG. 7, the horizontal direction indicates the transfer direction (direction Y).

Reference is made to FIG. 7. When a light beam leaving the objective 8-4 impinges upon a point a on the ink sheet 1, light reflected at the point a is polarized more in the vertical direction since the area at the point a is magnetized in one direction (FIG. 8A). When the light beam impinges upon a point c on the ink sheet 1, light reflected at the point c is polarized more in the horizontal direction since the area at the point c is magnetized in the other direction (FIG. 8C). When the light beam impinges upon a point c on the boundary between the areas of the points a and c, light reflected at the point b is polarized equally in both the vertical and the horizontal directions (FIG. 8B). In the optical head of the present invention, the thus polarized reflecting light from the ink sheet 1 is split into the polarized-light components, and the intensities of those polarized light components are detected by the sensors 8-10 and 8-11, and the output signals of the sensors are inputted to the differential amplifier 8-12. The differential amplifier 8-12 produces a tracking error signal $S_{ERR}$, which varies in its level with respect to the light beam irradiating positions (points a, b and c), as shown in FIG. 9. The actuator drive circuit 12 receives the thus varying tracking error signal $S_{ERR}$ and produces an actuator drive current $I_{ACT}$ which depends on the tracking error signal $S_{ERR}$. The actuator drive current $I_{ACT}$ drives the actuator 11 so as to remove a position error of the objective 8-4 in the direction Y or to bring the light beam to irradiate at the point b (FIG. 7). Thus, the actuator 11 adjusts the position of the objective 8-4 on the ink sheet 1 when viewed in the transport direction Y so that the light beam leaving the objective 8-4 always irradiates exactly at the point b on the ink sheet 1.

As described above, in the optical heads 81, 82, . . . , 8*n* of the printer shown in FIG. 1, the positions of the objectives 8-4 of those optical heads are controlled so that the light beams emanating from the optical heads are brought to irradiate exactly at the positions on the same line (FIG. 3). Therefore, the printer of the present invention can bring the laser beams to irradiate exactly at the positions on the ink sheet 1 when viewed in the transport direction Y, although the printer is provided with a plural number of optical heads 81, 82, . . . , 8*n*.

The optical heads 82, 83, . . . , 8*n*, allotted to the regions 2, 3, . . . , n on the ink sheet 1 FIG. 3), are thus constructed and operated. The optical head 81, allotted to the region 1 on the ink sheet 1, for forming a light spot on the region 1 will be described. The optical head 81 assigned to the region 1 does not have the function to print an image on the print sheet 2 or to form an image. For this reason, there is no need of forming the ink layer 11-3 in the region 1 on the ink sheet 1. Alternatively, the print sheet 2 may be layered only on the portion including the regions 2 to n on the ink sheet 1.

The basic construction of the optical head 81 is the same as that of the remaining optical heads allotted to the regions 2 to n. The differences of the optical head 81 from the remaining ones follows. The actuator drive circuit 12 associated with the optical head 81 receives a tracking error signal $S_{ERR}$ outputted from the differential amplifier 8-12 of the optical head 82, which is adjacent to the optical head 81 under discussion. Accordingly, the actuator drive circuit 12 generates an actuator drive current $I_{ACT}$ which depends on the tracking error signal $S_{ERR}$ outputted from the adjacent optical head 82, and applies it to the actuator 11 associated with the optical head 81. The actuator 11 thus driven adjusts the position of the objective 8-4 of the optical head 81. In other words, the objective 8-4 of the optical head 81 and the objective 8-4 of the adjacent optical head 82 are controlled in the same way. The output signal of the differential amplifier 8-12 of the optical head 81 allotted to the region 1 on the ink sheet 1 is used for another object to be described hereinafter.

The magnetization pattern of the region 1 contains the magnetized and the nonmagnetized portions alternately arrayed in the width direction X (FIG. 3). Therefore, when the optical head 81 is moved in the width direction X above along the ink sheet 1, the differential amplifier 8-12 of the optical head 81 produces pulses or pulsative signals at the intervals of the light spot.

The controller can know the current position of the optical head 81 relative to the ink sheet 1 from the number of the pulses (outputted from the differential amplifier 8-12), which is counted. The controller recognizes a time point that the light spot 131 reaches the position of the light spot 131*b*, viz., the light spots 132, . . . , 13*n* reach the light spots 132*b*, . . . , 13*nb* (FIG. 3), and carries out a process to make a print on the next line. Specifically, the drum 3 is turned by one step at that time. Even when the print progresses in the middle of one line, the controller knows the current position of the optical head 81 relative to the ink sheet 1 from the output signal of the differential amplifier 8-12 for the region 1. Therefore, if the ink sheet 1 and the print sheet 2 are irregularly moved in the width direction X while the ink sheet 1 is located on the print sheet 2, the printing operation is performed following up such an irregular motion.

As seen from the foregoing description, the printer of the present embodiment can print an image at high speed because it is provided with the plural number of optical heads 81, 82, . . . , 8*n*. Further, it can precisely control the irradiating positions of the laser beams on the ink sheet 1 in both the width direction X and the transport direction Y. This ensures a high definition of the printed picture.

Figure 11:
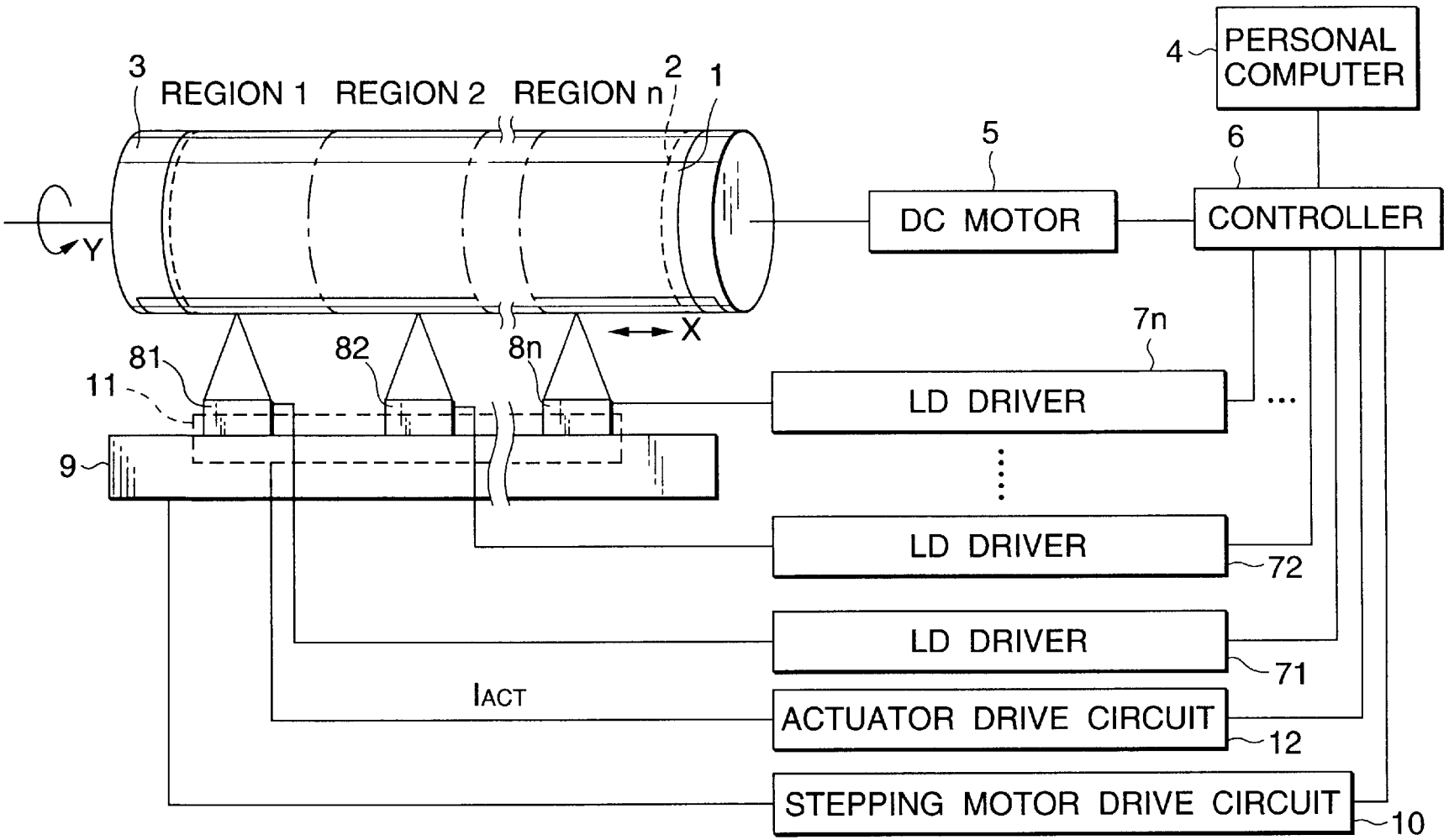
FIG. 11 is a diagram showing in schematic and block form another embodiment of a printer of the laser thermal-transfer type according to the present invention.
Figure 12:
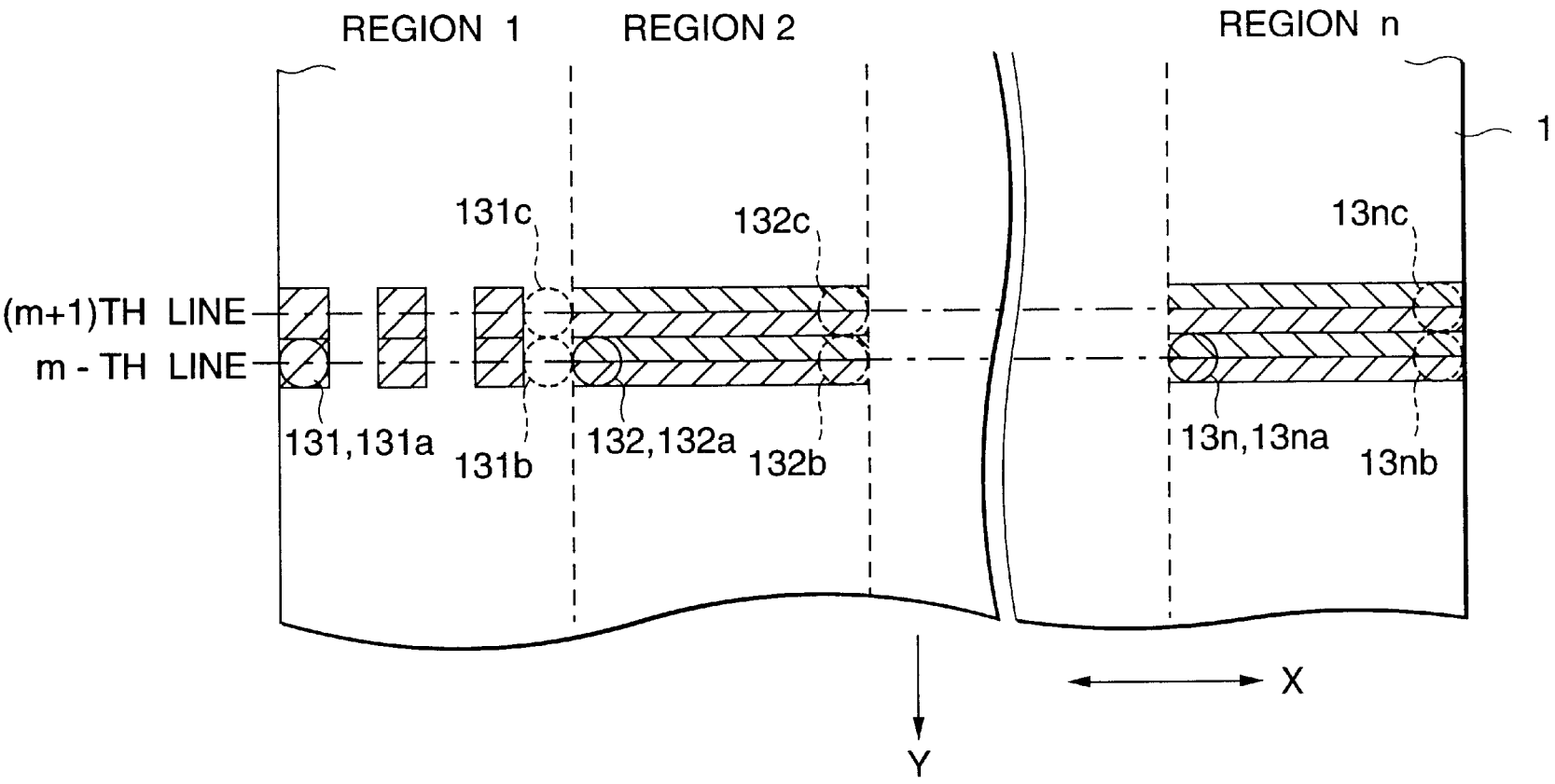
FIG. 12 is a diagram showing typical magnetization patterns on an ink sheet according to another embodiment of the present invention, the ink sheet being adequate for the printer of FIG. 11.

FIG. 11 is a diagram showing in schematic and block form another embodiment of a printer of the laser thermal-transfer type according to the present invention. FIG. 12 is a diagram showing typical magnetization patterns on an ink sheet according to another embodiment of the present invention, the ink sheet being adequate for the printer of FIG. 11. In those figures, like reference numerals are used for designating like or equivalent portions in FIGS. 1 and 3. Description of the second embodiment will be given placing emphasis on the differences of the second embodiment from the first embodiment.

In the second embodiment shown in FIG. 11, a single actuator 11 is used for the movement the objectives 8-4 of the plural number of optical heads 81, 82, . . . , 8*n*. An ink sheet 1 used for the present printer is designed such that magnetization patterns are formed only in the regions 1, and 2 and n of those regions 1 to n, as shown in FIG. 12. Accordingly, only the optical heads 81, 82 and 8*n* associated with those regions 1, 2 and n are provided with the Kerr-effect detecting optical systems. The remaining optical heads are provided with only the spot forming optical systems. The actuator 11 is driven by the actuator drive circuit 12. The actuator drive circuit 12 receives, through the controller 6, a signal representative of an average value of the tracking error signals $S_{ERR}$, which are outputted from differential amplifiers 8-12 of the optical heads 82 allotted to the regions 2 and n. The actuator drive circuit 12 generates an actuator drive current $I_{ACT}$ on the basis of the average value, and applies it to the actuator 11. Thus, one actuator 11 may be used for the plural number of optical heads 81, 82, . . . , 8*n*.

In the above-mentioned embodiments, the magnetization pattern of the region 1 on the ink sheet 1 contains the magnetized and the nonmagnetized portions alternately arrayed in the width direction X, as shown in FIGS. 3 and 12. Where the ink sheet transport system (e.g., the drum 3 in FIG. 1 or 11) is designed such that the irregular motion of the ink sheet 1 is reduced to be negligible, there is no need of using the magnetization pattern in the region 1. In this case, all of the regions on the ink sheet 1 may be used for printing an image.

An accuracy of the follow-up control of the light spot according to the present invention will be described.

Figure 13:
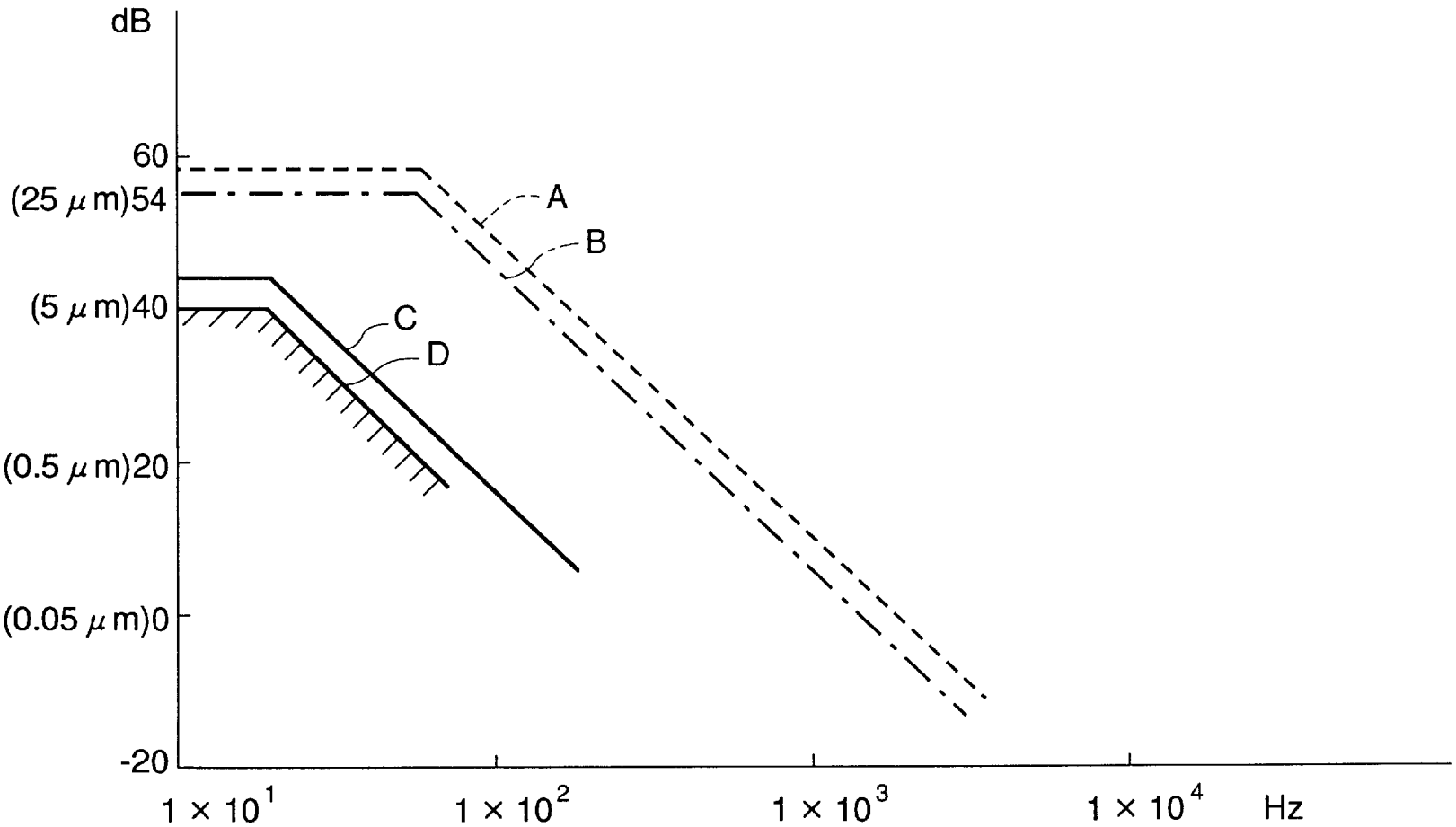
FIG. 13 is a graph showing a gain characteristic of a servo system.

FIG. 13 is a graph showing a gain characteristic of a servo system.

A servo characteristic of a tracking actuator for driving an optical head for the compact disc (CD) is represented by a dotted line A in FIG. 13. The actuator can follow up a minute motion by an eccentricity of ±25 μm (line B in FIG. 13) within an error of ±0.05 μm. In the printer of 2,000 dpi, the dot diameter is approximately 10 μm, and the positioning error of the light spot is ±5 μm (line D in FIG. 13) on the ink sheet 1. The actuator of the servo characteristic representative of the line A is capable of sufficiently reducing the position error to within ±0.5 μm (5% of the spot diameter). Also in the printed picture of high definition of approximately 10,000 dpi (dot diameter=1 μm and the positioning error=±0.1 μm), it is easy to secure the positioning error (±0.1 μm) of 5% or smaller of the spot diameter.

In the case of the definition of 2,000 dpi or less, two more optical heads may be driven by using a single actuator. An example of this is the case of FIG. 11 in which an n number of optical heads 81, 82, . . . , 8*n* are driven by one actuator 11. In this case, if the number of optical heads is increased, the necessary number of the actuators and the actuator drive circuits may be reduced.

In this case, there is a fear that the increased weight of the actuators will deteriorate the positioning accuracy. However, it is easy to secure the positioning accuracy of ±0.5 μm (required for 2,000 dpi) if five optical heads or smaller are used for one actuator. The crossing-point frequency required for the optical head servo system is approximately 12 kHz, and the resonance frequency required for the actuator is approximately 20 kHz. The crossing-point frequency required for the printer servo system is approximately 80 Hz, and the resonance frequency required for the actuator is approximately 800 Hz (line D in FIG. 13). The resonance frequency is inversely proportional to the square root of the weight. Thus, the resonance frequency is reduced from 20 kHz to 800 Hz, and hence it is possible to secure the positioning accuracy of approximately ±0.5 μm if the weight of the printer actuator is about five times as large as that of the optical head actuator.

In the above-mentioned embodiments, the magnetization pattern on the ink sheet consists of different magnetization alternately arrayed in the width direction or the transport direction. The magnetization pattern on the ink sheet may consist of three or more different magnetized portions that "cyclically" appear. In a specific example of the magnetization pattern, a first portion magnetized in a direction, a second portion magnetized in another direction, and a third portion not magnetized cyclically appear on the ink sheet.

A method of manufacturing the ink sheet will be described.

1) A base film, e.g., a rolled PET film, is continuously rolled out, and is uniformly coated with magnetic powder, to thereby form a magnetic layer.

2) A light absorbing layer and an ink layer are formed in this order on the magnetic layer.

3) Magnetization patterns are formed along the print lines by using a long, magnetic record head arranged in the width direction of the base film. In this case, the polarities of the magnetization patterns, formed along the print lines, are alternately inverted. Then, the ink sheet with the magnetization patterns thus formed is wound up. When the layer coating work and the magnetization pattern recording work are sequentially exercised in this way, the efficiency of manufacturing the ink sheet is improved. In the present invention, the print positions are corrected using the magnetization patterns recorded on the ink sheet. Therefore, the accuracy of recording the magnetization patterns affects a great influence to the quality of the printed picture. However, this is negligible actually for the following reason. The speed of the magnetization patterns recording process may be sufficiently larger than the speed of the layer coating process. Accordingly, if the recording operation of the magnetic patterns is performed during the transportation of the ink sheet, there is less chance that the recorded magnetization patterns are deformed.

As seen from the foregoing description, the printer of the laser thermal-transfer type according to the present invention employs a feedback control using a magnetic layer on the ink sheet. With the use of the feedback control, the printer can accurately position the picture elements. A high definition printer system of 2,000 dpi or higher may be realized. Further, the printer of the present invention is provided with a plural number of optical heads. With use of the plural number of the optical heads, a high speed printing of an image is realized, with its resultant printed picture of high definition.

What is claimed is:

1. A printer having a recording medium and an ink sheet, said ink sheet including an ink layer containing ink, the ink being molten by heat generated by absorption of received light, the ink being transferred to said recording medium when said ink sheet receives light, and a magnetic layer disposed on said ink sheet, said magnetic layer being magnetized to have a preset magnetic pattern which varies, part of the received light being incident on and reflected from said magnetic layer, a direction of polarization of the reflecting light also varies depending on the magnetization on said magnetic layer, said printer comprising:

light beam projecting means for projecting a light beam on said ink sheet while moving in a width direction of said ink sheet, said light beam having an irradiating position;

sensing means for sensing a polarization of the light beam as the light beam is reflected from said ink sheet; and at least one irradiating position adjusting means for adjusting the irradiating position of the light beam on said ink sheet based on the polarization of the reflecting light that is sensed by said sensing means, the light beam being projected from said light beam projecting means irradiating on the irradiating position on said ink sheet.

2. The printer of claim 1, wherein said light beam projecting means includes a plurality of optical heads, and said at least one irradiating position adjusting means comprises a plurality of actuators, each one of said plurality of optical heads associated with a respective one of said actuators.

3. The printer of claim 1, wherein said light beam projecting means includes:

a plurality of optical heads associating with one said irradiating position adjusting means, said one said irradiating position adjusting means adjusting irradiating positions of the light beams projected from said plurality of optical heads associated therewith, on said ink sheet.

4. The printer of claim 1, wherein the magnetic pattern alternately or cyclically varies in a length direction of said ink sheet.

5. The printer of claim 4, further comprising:

a second magnetic pattern in a portion of the magnetic layer, the second magnetic pattern alternately or cyclically varying in the width direction of said ink sheet;

second light beam projecting means for projecting a light beam on a portion on said ink sheet while relatively moving in the width direction of the ink sheet;

second sensing means for sensing the polarization of the light beam reflected from the portion on said ink sheet; and detecting means for detecting a position of said second light beam projecting means relative to said ink sheet based on the polarization of the reflecting light that is sensed by said second sensing means.

6. A printing apparatus comprising:

an ink sheet including a magnetized layer having a preset pattern, the magnetized layer being disposed between a transparent base film layer and a light absorbing layer, the ink sheet further including an ink layer which forms an image on a print sheet when the ink layer is molten by heat generated by absorption of received light;

a plurality of light beam devices, the light beam devices emitting light beams onto the light absorbing layer thereby creating thermal energy, wherein the light beams are also reflected in the magnetic layer thereby changing polarization;

a sensing device disposed proximate to the ink sheet, the sensing device sensing the changing polarization; and a plurality of light beam adjusting devices disposed proximate to each of said plurality of light beam devices, respectively, the light beam adjusting devices adjusting the position of the light beams in response to the detected change of polarization so that the light beam devices can be accurately positioned for emitting light onto the ink sheet.

7. The apparatus of claim 6, wherein the change of polarization depends on a magnetization on a reflection point on the magnetic layer.

8. The apparatus of claim 6, wherein the magnetic pattern alternately or cyclically varies in a length direction of the ink sheet.

9. The apparatus of claim 6, wherein each of the plurality of light beam adjusting devices includes an actuator, wherein each of the plurality of light beam devices comprises an optical head, and wherein each said actuator and each said optical head are respectively coupled to each other.

10. The apparatus of claim 9, wherein each said optical head is driven by one actuator.

11. The apparatus of claim 6, further comprising:

a second magnetic pattern in a portion of the magnetic layer, the second magnetic pattern alternately or cyclically varying in a width direction of the ink sheet;

an additional light beam device emitting a light beam onto the portion of the magnetic layer;

a second sensing device disposed proximate to the ink sheet, the second sensing device sensing a polarization of the light beam as the light beam is reflected from the portion of the magnetic layer; and a detecting device disposed proximate to the second sensing device, the detecting device detecting a position of the additional light beam device relative to the ink sheet.

12. In combination, an ink sheet and a printer, the ink sheet comprising:

a base layer;

an ink layer containing ink capable of being molten by heat generated by absorption of received light and transferred onto a print sheet for image formation; and a magnetic layer being disposed between said base layer and said ink layer, said magnetic layer being magnetized to have a preset magnetic pattern which varies, part of the received light being incident on and reflected from said magnetic layer, wherein a direction of polarization of the reflecting light varies depending on the magnetization on said magnetic layers, the printer comprising:

light beam projecting means for projecting a light beam on said ink sheet while moving in a width direction of said ink sheet said, light beam having an irradiating position;

sensing means for sensing a polarization of the light beam as the light beam is reflected from said ink sheet; and at least one irradiating position adjusting means for adjusting the irradiating position of the light beam on said ink sheet based on the polarization of the reflecting light that is sensed by said sensing means, the light beam being projected from said light beam projecting means irradiating on the irradiating position on said ink sheet.

* * * * *